United States Patent [19]

Carter, Jr.

[11] 4,338,999

[45] Jul. 13, 1982

[54] KNOCKOUT PIN TRAP

[75] Inventor: Ernest E. Carter, Jr., Duncan, Okla.

[73] Assignee: Halliburton Company, Duncan, Okla.

[21] Appl. No.: 122,109

[22] Filed: Feb. 19, 1980

[51] Int. Cl.[3] ..... E21B 31/08

[52] U.S. Cl. ..... 166/117; 29/160; 166/99; 166/187; 166/227; 166/328; 210/445

[58] Field of Search ..... 166/317, 334, 325, 99, 166/187, 117, 328; 175/312; 137/540, 11; 210/445, 450, 154, 431, 430, 163; 52/12; 404/3, 4; 405/127, 119; 29/160

[56] References Cited

U.S. PATENT DOCUMENTS

| | | | |
|---|---|---|---|
| 504,679 | 9/1893 | Gibson | 166/99 |
| 1,167,670 | 1/1916 | Wheeler | 175/312 X |
| 1,465,320 | 8/1923 | Spruill | 166/99 |
| 1,651,321 | 11/1927 | Burkelman | 210/163 |
| 1,722,965 | 7/1929 | Patton | 166/234 X |
| 1,880,004 | 9/1932 | Warswick | 166/99 |
| 1,908,933 | 5/1933 | Tinello | 210/445 X |
| 2,011,518 | 8/1935 | Griffin | 175/314 |
| 3,086,655 | 4/1963 | Compton | 210/153 |

*Primary Examiner*—William F. Pate, III

*Attorney, Agent, or Firm*—Joseph A. Walkowski; John H. Tregoning

[57] ABSTRACT

A trap to catch knockout plugs or "pins" from casing inflation packers. The trap is mounted in the well casing above a float valve, and catches pins falling from casing inflation packers in the casing above it as these pins are broken off by a cementing plug descending into the well, thus preventing the loose pins from jamming the float valve open after cementing is completed. The trap comprises a generally cylindrical hollow body having rods extending laterally across its bore, and a collapsible pin guide mounted on top of the body to guide the pins into the body, where they are constrained above the float valve by the rods.

23 Claims, 4 Drawing Figures

KNOCKOUT PIN TRAP

When casing is inserted into a well bore, it is subsequently fixed and supported therein by an operation known as primary cementing. Cement is forced down the bore of the casing, through an aperture in the guide shoe at the bottom of the casing, and up the annulus between the casing and the well bore to the desired level. One or more float valves are installed in the casing to prevent back flow of the cement into the casing from the annulus if pressure in the casing is reduced. A float valve may be in the form of a collar or as an integral part of the guide shoe. The closed float valve or valves also seal the bottom of the casing and prevent fluids in the well bore from filling it when the casing is lowered into the well bore, thus providing buoyancy in the casing and reducing total weight supported by the derrick. Illustrative of this type of float valve are the Halliburton Float Collar with Super Seal Valve and the Super Seal Float Shoe, depicted on pages 3324 and 3313, respectively, of Halliburton Services Sales and Service Catalog Number 40. After the casing is in place in the well bore, a bottom cement plug may be pumped before the cement, in order to displace any fluid in the casing, down through the casing to seat above the uppermost float valve, at which point pressure is increased in the casing, a diaphragm in the bottom plug is ruptured, and cement flows through the bottom plug, opening the float valve (or valves) by overcoming its biasing mechanism. The cement then travels to the well bore annulus, as previously described. A top plug follows the cement, and is pumped down the casing bore to seat on the bottom plug, at which point the back pressure from the cement in the casing below the float valve, and in the well bore annulus is supposed to close the valve. However, in practice there arises a difficulty associated with the use of casing inflation packers in the casing above the float valve. These casing inflation packers, of which the Lynes External Casing Packer, described on page 4388 of the 1978–1979 Composite Catalog® of Oil Field Equipment and Services and the Tam Cap TM Casing Annulus Packer, shown on page 6344 of the above catalog, are representative, are commonly placed in the casing string to isolate intervals of the well bore for stage cementing and gravel packing operations. These packers employ a metal or plastic plug or pin, commonly referred to as a "knockout pin," to seal the packer valve opening into the casing bore to prevent premature inflation of the casing inflation packer from pressure created inside the casing after its insertion into the well bore when drilling fluid is circulated into the casing prior to cementing. In some instances, it may be necessary to circulate even before cementing, such as when a hole caves in, in deviated holes or where mud cake on the wall of the well bore creates a tight spot. All of these situations necessitate circulation to free the casing, and could cause the packer in the casing string to inflate prematurely. When circulation has been established in the casing and cementing commences, if a bottom plug is employed, it breaks off the knockout pins as it descends in the casing, after which the knockout pins fall (or are pushed ahead of the plug in deviated holes) to the float valve. If no bottom plug is used, the knockout pins remain in place during primary cementing and ensure a seal against possible cement incursion into the valves of the packers until the top plug breaks the pins off. While ideally the knockout pins remain above the float valve or pass through it with the flow of cement, in practice, particularly when a number of casing inflation packers are employed as when multiple intervals in a well are to be cemented or gravel packed, one or more pins are caught in the valve assembly, jamming it open. As a result, when the top plug reaches the float valve, and the cementing is completed, pressure must be maintained in the casing until the cement sets, an inconvenient procedure, as no other operations may be performed in the well until the operator is sure that setting has taken place. In addition, if the pressurizing system fails prior to the setting of the cement, it flows back into and sets in the casing, leaving an insufficient amount of cement in the annulus. After such an occurrence the set cement must be drilled out and the well recemented, a particularly time consuming and costly operation.

The apparatus of the present invention provides a heretofore unknown solution to the problems described above. The present invention comprises a generally cylindrical hollow body, with a plurality of rods extending laterally across its bore. The spacing between the rods is less than the diameter of the smallest knockout pins employed in the well, and the rods themselves are positioned in an inverted vee configuration so as to direct the pins to the sides of the body and enhance flow of cement therethrough. Above the body a frusto-conical sheet metal pin guide directs the falling pins into the hollow body of the pin trap. After the pins have entered the hollow body, the bottom cement plug (or top, if no bottom plug is used) contacts the pin guide, crushing it flat against the pin trap body, against which the plug then seats. It is apparent that cementing may proceed through the ruptured bottom plug (if one is used), knockout pin trap and float valve, after which the float valve may seal without interference as all knockout pins have been caught in the trap.

The foregoing advantages and preferred embodiments of the invention will be better understood from the following description taken in conjunction with the accompanying drawings wherein.

Figure 1:
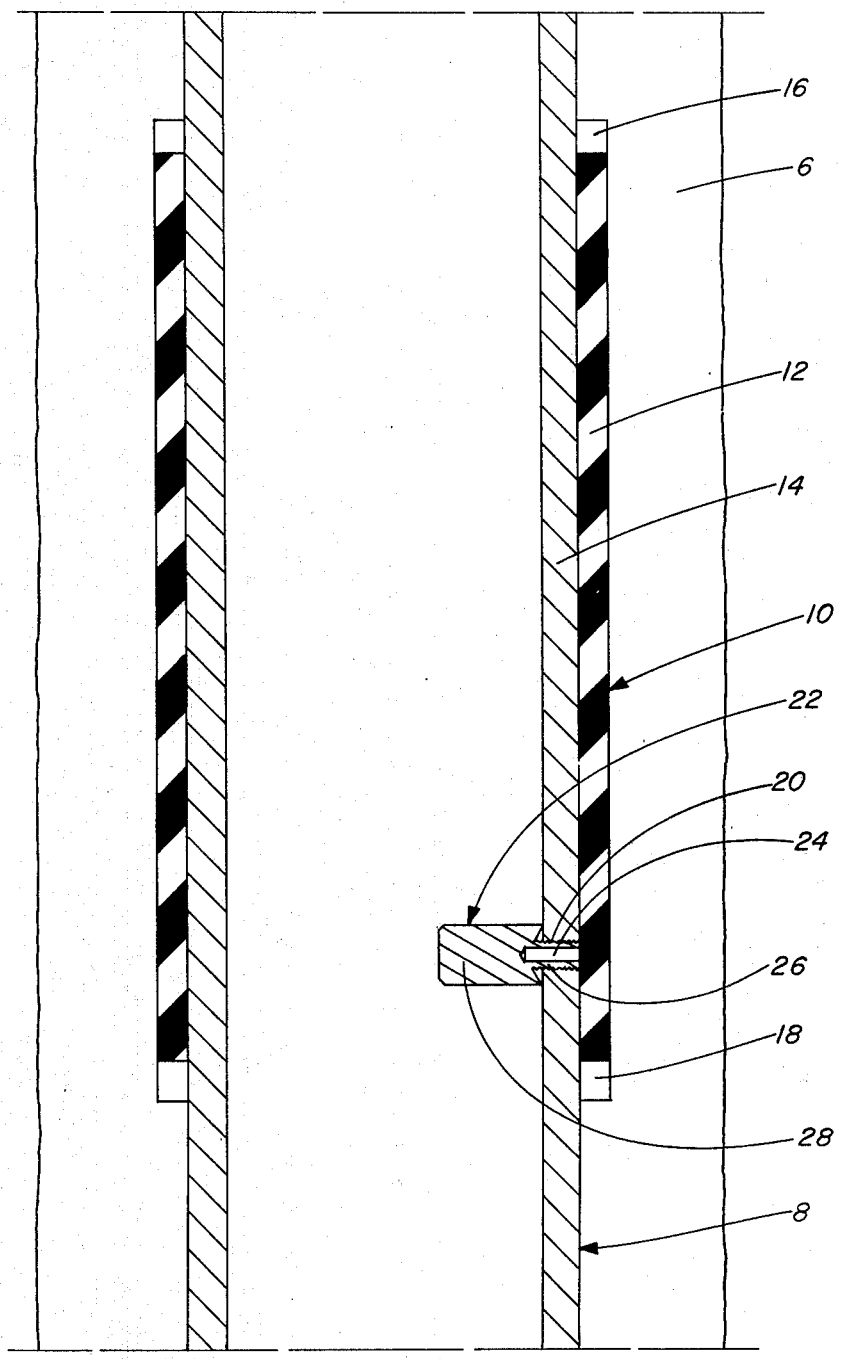
FIG. 1 is a schematic vertical cross-sectional elevation of a length of casing with an uninflated casing inflation packer, the knockout pin being in place.
Figure 2:
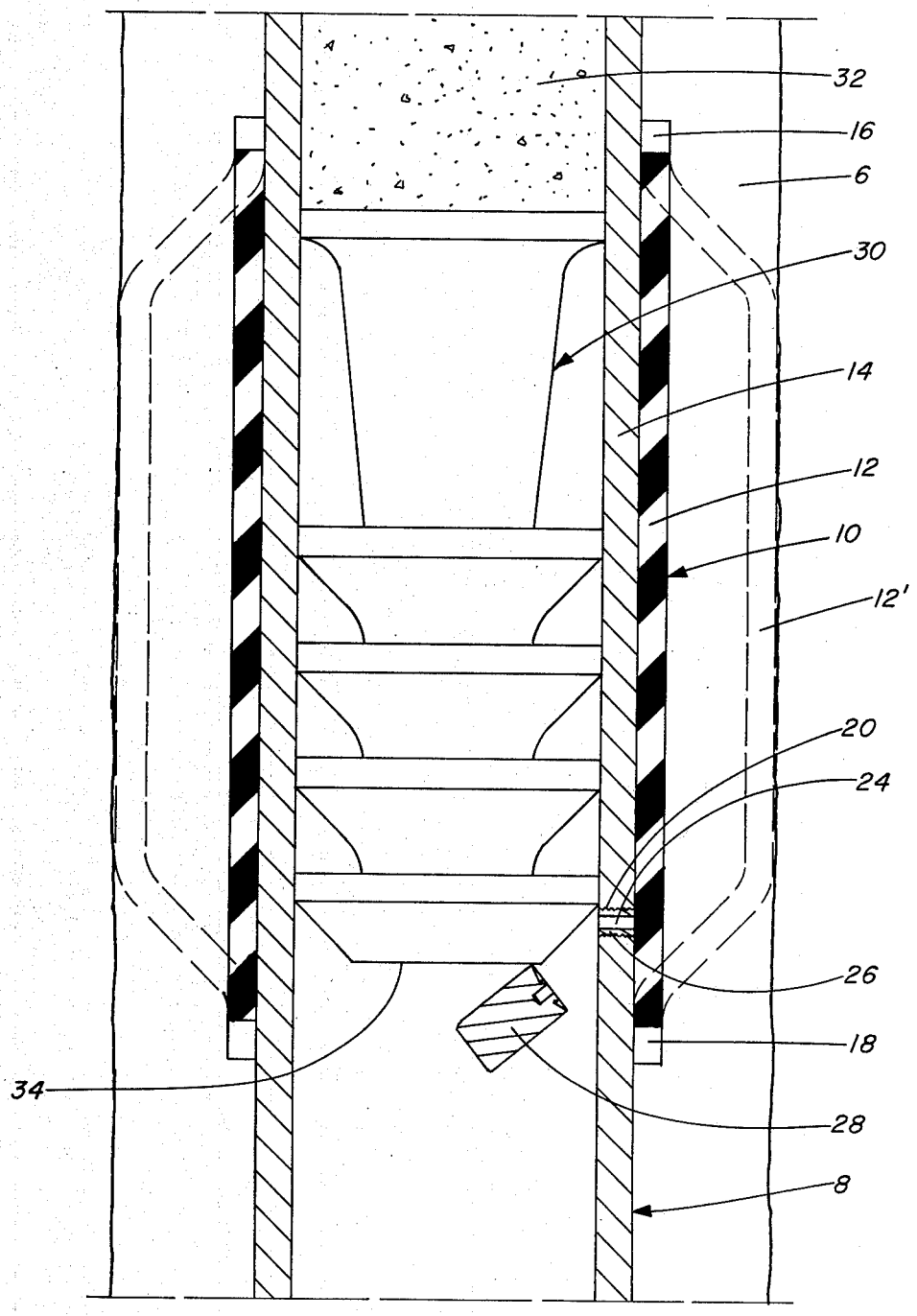
FIG. 2 is the same schematic vertical cross-sectional elevation with a bottom cementing plug descending into the casing, breaking off the knockout pin.

Referring to FIGS. 1 and 2, casing string 8 is shown schematically in the well bore 6 before cementing. Casing inflation packer 10 is shown schematically as part of casing string 6, and comprises a tubular elastomeric bladder 12 fixed and sealed to inner mandrel 14 at points 16 and 18. The packer 10 is inflated through aperture 20 leading to a valve assembly (not shown) inside the wall of mandrel 14. Aperture 20 is sealed during insertion of casing string 8 into well bore 6 by knockout pin 22, which is threaded to aperture 20. Knockout pin 22 is usually formed of metal or plastic, and bore 24 runs from the end of the threaded portion 26 into the larger diameter body 28 which extends into the bore of casing 8. Referring to FIG. 2, bottom cement plug 30 is shown descending through the casing bore, being propelled therethrough by cement 32 above it. When the leading end 34 of plug 30 contacts knockout pin 22, it breaks off at the inner wall of mandrel 14, exposing the valve assembly of the packer for subsequent inflation through bore 24 of threaded pin end 26. Broken lines depict bladder 12 after inflation at 12'. Body 28 of knockout pin 22 then falls, or is pushed ahead of plug 30 to the vicinity of the uppermost float valve in the casing, where jamming is likely to occur.

Figure 3:
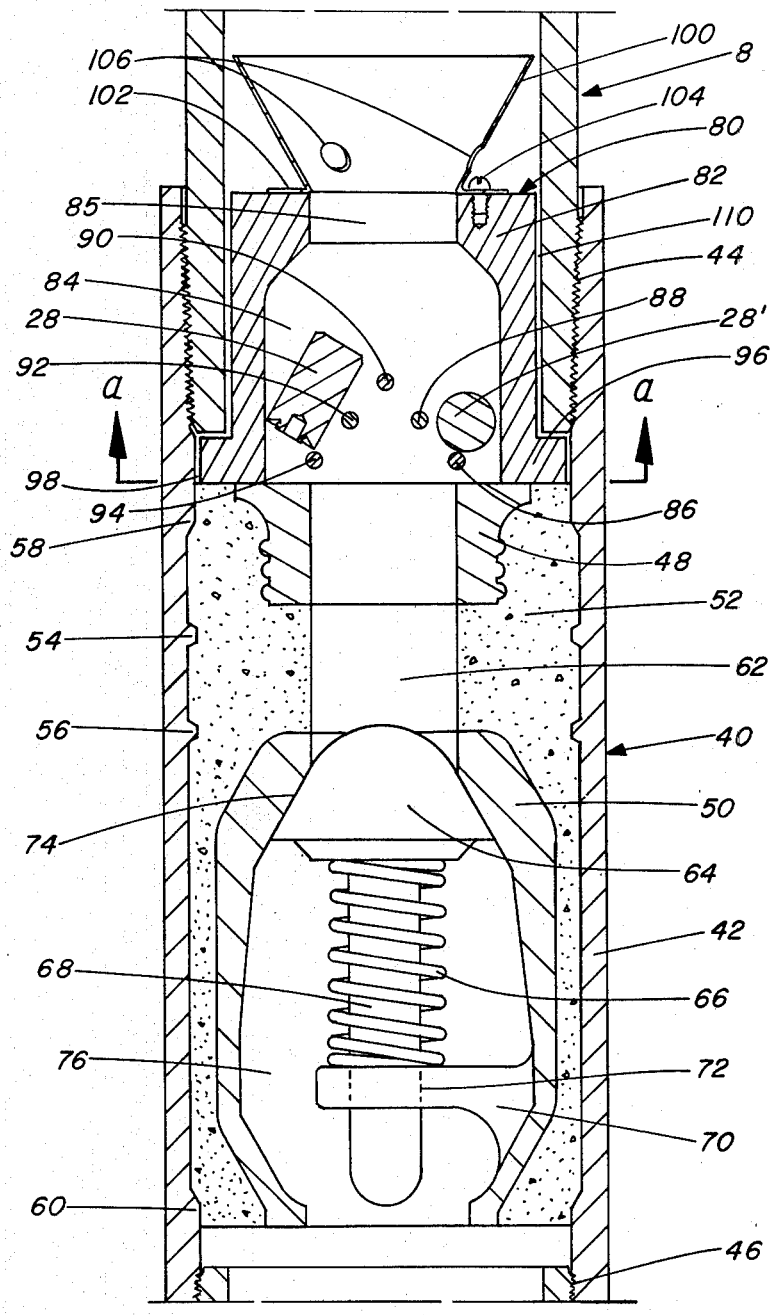
FIG. 3 is a vertical cross-sectional elevation of the knockout pin trap of the present invention above a float collar, with knockout pins in the body of the trap.

FIG. 3 depicts the location where casing string 8 joins the top float valve, in this instance float collar 40, below the casing inflation packer in the string. Float collar 40 comprises an outer housing 42, with threads 44 and 46 at its upper and lower ends, respectively. Below float collar 42, casing string 8 continues downward (not shown) where other float collars may be placed, and the casing being finally terminated by a guide shoe. Within housing 42, plug seat 48 and valve seat 50 are molded in cementitious material 52, which is held in place within housing 42 and reinforced against the shock of a plug landing by annular shoulders 54 and 56 as well as reduced inner diameter areas 58 and 60 at each end of housing 42. Plug seat 48 and valve seat 50 may be formed of metal, as shown, or of a plastic material. Collar bore 62 extends through plug seat 48 and cementitious material 52 to valve seat 50. Valve head 64 (surfaced with an elastomeric material) is biased against valve seat 50, closing bore 62 at its lower end, by coil spring 66 which surrounds rod 68 upon which valve head 64 is mounted. Rod 68 extends through axially oriented aperture 72 in arm 70 of valve seat 50. Valve head 64, coil spring 66, rod 68 and arm 70 have not been shown in section, for purposes of clarity. Valve seat bore 74 is enlarged below seating area 76 to provide free flow for the cement after it forces valve head 64 downward, compressing spring 66. After flow of cement stops, compressed spring 66 once again forces valve head 64 against seating area 74. It is between valve head 64 and seating area 74 that jamming with knockout pins occurs, preventing spring 66 from moving valve head 64 upward to seat. To eliminate this problem, pin trap 80 is placed above float collar 40 and is maintained in place by the end of casing string 8. Pin trap 30 comprises cylindrical body 82, of aluminum or other drillable metal, body 82 having trap bore 84 therein. Trap bore 84 is constricted at its upper end 85, and widens to a substantially uniform diameter below the constriction. Baffle rods 86, 88, 90, 92 and 94 are extended laterally across trap bore 84, rod 90 being longitudinally uppermost, with rods 88 and 92 lower, and rods 86 and 94 still lower to form an inverted vee when observing the rods end-on, as in FIG. 3. Trap body 82 has flange 96 at its lower end, flange 96 extending into recess 98 between the end of casing string 8 and the top of cementitious material 52 in float collar 40, thus ensuring the position of pin trap 80. Above trap body 82 is inverted frustoconical pin guide 100, formed of a relatively malleable and drillable metal such as aluminum. Pin guide 100 is fixed to trap body 82 by three circumferentially spaced screws 104 extending through lip 102 at the lowest end of pin guide 100. Apertures 106 in pin guide 100 are circumferentially aligned with screws 104 to permit easy access to the screw heads. The bottom inner edge of pin guide 100 defines a circular aperture of substantially the same diameter as the upper constriction 85 of trap bore 84, while the top edge defines an aperture only slightly smaller than the inner diameter of casing string 8.

Figure 4:
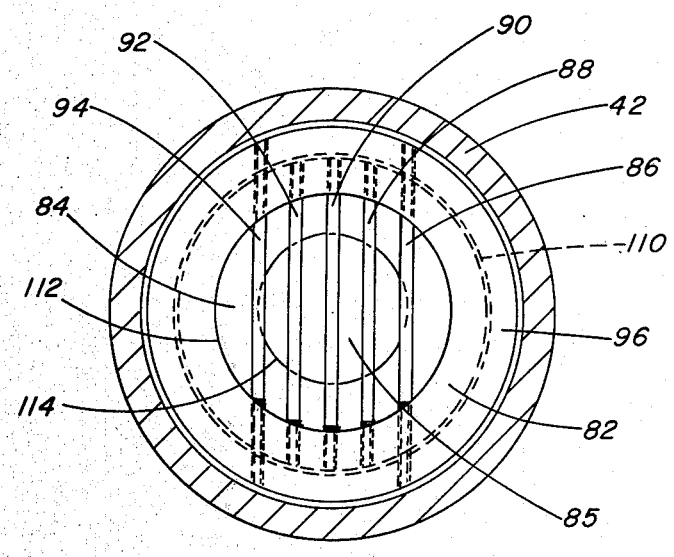
FIG. 4 is a section across line a—a of FIG. 3.

Referring to FIG. 4, taken across line a—a of FIG. 3, housing 42 of float collar 40 is shown in section. The bottom of flange 96 is shown, the two adjacent broken lines at 110 depicting the narrow annulus between the inside of casing string 8 and the outside of trap body 82 (see also FIG. 3). The inner diameter of the lower portion of trap bore 84 is shown at 112, while that of constricted upper portion 85 is shown at 114. Baffle rods 86, 88, 90, 92 and 94, which have threaded leading ends, are inserted through holes in one side of trap body 82, and screwed into threaded holes on the other side. Any excess rod is then ground from the outside of the trap body 82. Knockout pin bodies 28 and 28' have been omitted from FIG. 4 for the sake of clarity.

Referring again to FIG. 3, operation of the present invention may be determined. Knockout pin body 28, as well as substantially identical knockout pin 28' have been snapped from casing inflation packers above pin trap 80 in casing string 8. When the knockout pin bodies 28 and 28' encounter pin guide 100, they are directed inwardly to the constricted upper portion 85 of trap bore 84, through which they enter trap body 82. As the knockout pins 28 and 28' contact rods 86, 88, 90, 92 and 94, the inverted vee configuration directs them toward the inside wall of trap body 82, away from the main flow of cement. This feature is particularly critical in smaller diameter casing, where pin bodies would obstruct the flow if more than one or two packers are used in the casing string and a flat baffle configuration was employed. Pin bodies 28 and 28' are contained in trap body 82 by the time the cement plug 32 contacts pin guide, crushing it flat against trap body 82 and seating against its top. In reality, the impact of the plug causes the soft aluminum of the pin guide to behave plastically, further enhancing the seat of plug 32 against trap body 82.

The five baffle rods shown in FIG. 3 are merely illustrative of the present invention, and are not intended as limitations thereof. In the smallest size casing, only three seals might be used, while in larger casing, for example $9\frac{5}{8}''$, as many as nine might be used, the important feature being the inverted vee configuration to direct pin bodies away from the main fluid flow through the pin trap. In casing larger than $9\frac{5}{8}''$, the inverted vee configuration might be dispensed with, as the presence of pin bodies becomes less critical due to the greatly increased cross-sectional area of the casing bore.

It is apparent that the present invention presents a novel and unobvious solution to the problem of float valve jamming. While the present invention has been described with respect to catching knockout pin bodies, it is obvious that such a trap may be employed in a casing string wherever there is a probability of relatively small objects falling and interfering with the operation of equipment in the string. It would be apparent to one of ordinary skill in the art that the pin guide might be formed of a plastic material, and that any drillable material capable of handling plug impact might be employed as a trap body. It is also apparent that a pin trap may be integrated with the design of a float valve to form a single piece of float equipment. For example, plug seat 48 could be eliminated and an assembled trap body with rods in place could be cast in the cementitious material with valve seat 50, pin guide 100 being subsequently screwed to the top of the trap body. Moreover, the disclosed baffle rods of the present invention could be replaced by a broad mesh metal screen, bent in the middle to form two planes directing the knockout pins to the body wall. Alternatively, the mesh could be formed in an inverted cone shape. Furthermore, a coil of wire could be wound to form such an inverted cone. The pin guide illustrated herein could be eliminated by forming the top of the body with an inward-sloping annular shoulder to direct pins into the trap, and designing the leading end of a cement plug to be used with the trap seat on such a surface. Numerous other modifications, substitutions, additions and deletions may be made without departing from the spirit and scope of the claimed invention.

I claim:

1. An apparatus for stopping the movement of solid objects therethrough, comprising:

a body having a bore therethrough;

baffle means across said bore, said baffle means adapted to permit fluid flow therethrough and to stop the movement of solid objects greater than a predetermined size; and guide means leading to said bore and adapted to direct solid objects therein, said guide means being collapsible against said body.

2. The apparatus of claim 1, wherein said baffle means is further adapted to direct said solid objects toward the wall of said bore.

3. The apparatus of claim 1, wherein said body possesses flange means thereon.

4. A trap for arresting the movement of objects therethrough, comprising:

substantially cylindrical body means having axial bore means therethrough;

baffle means across said bore means; and guide means comprising a thin sheet material and having an inverted frustoconically shaped bore therethrough leading to said bore means at the top of said body means.

5. The apparatus of claim 4, wherein said bore means in said body means is constricted at one end of said body means, and said constricted end of said bore means communicates with said guide means bore.

6. The apparatus of claim 5, wherein said baffle means is disposed in the unconstricted portion of said bore means.

7. The apparatus of claim 4, wherein the radial extent of the top edge of said guide means is substantially equal to the radial extent of said body means.

8. The apparatus of claim 7, wherein said body means possesses flange means thereon extending beyond said radial extent of said body means.

9. The apparatus of claim 4, wherein said baffle means comprises a plurality of rods.

10. The apparatus of claim 9, wherein said rods are substantially parallel to and laterally spaced from each other.

11. The apparatus of claim 10, wherein said plurality of rods comprises at least three rods, the middle of said rods being disposed longitudinally higher in said bore means than said other rods.

12. The apparatus of claim 10, wherein said rods on either side of said middle rod are disposed in said bore means so as to define two planes sloping downward away from said middle rod.

13. The apparatus of claim 4, wherein said baffle means defines two planes sloping downward from a line extending diametrically across said bore means.

14. The apparatus of claim 4, wherein all materials in aid apparatus are drillable.

15. A knockout pin trap adapted to be disposed in well casing, comprising:

a substantially cylindrical body having an axially extending bore therethrough;

baffle means across said bore means; and pin guide means formed of sheet material defining an inverted frustoconical bore communicating with said body bore.

16. The apparatus of claim 15, wherein the radial extent of the wider end of said frusto-conical bore is substantially the same as the inner diameter of said well casing.

17. The apparatus of claim 15, wherein said baffle means comprises a plurality of substantially parallel, laterally offset rods.

18. The apparatus of claim 17, wherein said plurality of rods comprises at least three rods, the middle of which is disposed in a longitudinally higher position in said bore.

19. The apparatus of claim 18, wherein said plurality of rods define two downward-sloping planes from the middle of said bore to the wall of said bore.

20. The apparatus of claim 15, wherein said baffle means is adapted to direct knockout pins passing through said trap toward the wall of said body bore.

21. The apparatus of claim 15, further comprising flange means radiating from said body.

22. The apparatus of claim 15, wherein all components of said pin trap are drillable.

23. A method of making a knockout pin trap, comprising:

forming a bore in a substantially cylindrical body;

drilling an even plurality of horizontally extending holes through the wall of said body, half of said holes being located in a first half of the periphery of said body, and half of said holes being located in a second half of said periphery, said holes being drilled in an inverted vee shaped pattern in both said first and second halves of said periphery, the holes in each half of said periphery being parallel to all others in said half, each one of said holes in a half periphery being coaxial with a hole in the other half periphery;

tapping all holes in said first half;

inserting rods with threads on at least one end thereof through the holes in said second half;

extending said rods across said bore to said tapped holes;

screwing said rods into said tapped holes; and grinding off any excess rod extending outside of said body.

* * * * *